US012320202B2

(12) United States Patent
Eiman

(10) Patent No.: US 12,320,202 B2
(45) Date of Patent: Jun. 3, 2025

(54) DOWNHOLE WET-MATE SYSTEMS WITH OFFSET STINGER AND METHODS FOR DEPLOYMENT AND WET-MATE CONNECTING BY ROTATION OF THE OFFSET STINGER

(71) Applicant: Halliburton Energy Services, Inc., Houston, TX (US)

(72) Inventor: Tyson H. Eiman, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 160 days.

(21) Appl. No.: 18/358,078

(22) Filed: Jul. 25, 2023

(65) Prior Publication Data

US 2025/0034952 A1 Jan. 30, 2025

(51) Int. Cl.
*E21B 17/02* (2006.01)
*E21B 43/02* (2006.01)

(52) U.S. Cl.
CPC ..... *E21B 17/028* (2013.01); *E21B 17/021* (2013.01); *E21B 43/02* (2013.01)

(58) Field of Classification Search
CPC ..... E21B 17/021; E21B 17/023; E21B 17/028
See application file for complete search history.

(56) References Cited

U.S. PATENT DOCUMENTS 7,165,892 B2 1/2007 Grigsby et al.
7,556,093 B2 7/2009 Grigsby et al.
7,900,698 B2 3/2011 Stoesz
2009/0045146 A1* 2/2009 Stoesz ..... E21B 23/00 210/470
2010/0300695 A1 12/2010 Brown et al.
2014/0020907 A1 1/2014 Head
(Continued)

FOREIGN PATENT DOCUMENTS

WO 2022109157 A1 5/2022
WO 2022155592 A1 7/2022
WO 2022192669 A1 9/2022

OTHER PUBLICATIONS

TE Connectivity,"Seacon G3 Low Profile, Low Loss Optical Performance, Optical Wet-Mate Connector." (2019) 2 pgs. https://www.te.com/commerce/DocumentDelivery/DDEController?Action=srchrtrv&DocNm=2363000-1_seacon-G3-optical&DocType=DS&DocLang=EN.

(Continued)

*Primary Examiner* — Giovanna Wright
(74) *Attorney, Agent, or Firm* — K&L Gates LLP

(57) ABSTRACT

A completion system is provided for use downhole in a wellbore that includes a pipe with a restriction inside the pipe. The system includes an upper completion assembly with a mandrel with a mandrel axis and a stinger sub rotatably connected with the mandrel and rotatable around a stinger axis offset from the mandrel axis. The stinger sub also includes a first portion wet-mate connector located in a radially outward portion of the stinger sub. The system also includes a lower completion assembly with a second portion wet-mate connector. The first and second portion wet-mate connectors are connectable downhole. Further, rotation of the stinger sub around the stinger axis rotates and moves the radially outward portion radially inward with respect to the mandrel axis. Doing allows the upper completion assembly to move past a restriction and further downhole into the wellbore.

20 Claims, 9 Drawing Sheets

(56) References Cited

U.S. PATENT DOCUMENTS

| | | | | |
|---|---|---|---|---|
| 2016/0168923 | A1 | 6/2016 | Richards | |
| 2021/0032940 | A1* | 2/2021 | Simonsen | E21B 17/028 |
| 2024/0076942 | A1* | 3/2024 | Cassidy | E21B 17/0283 |

OTHER PUBLICATIONS

"PCT Application No. PCT/US2023/070884", International Search Report and Written Opinion, Apr. 22, 2024, 9 pages.

* cited by examiner

DOWNHOLE WET-MATE SYSTEMS WITH OFFSET STINGER AND METHODS FOR DEPLOYMENT AND WET-MATE CONNECTING BY ROTATION OF THE OFFSET STINGER

BACKGROUND

The utilization of advanced communication lines in various industries has gained significant traction in recent years. One notable example is the utilization of fiber optic technology, which has proven to be highly beneficial. This technology facilitates the transmission of valuable data in different industries, such as the oil and gas industry, allowing for improved monitoring and optimization of various parameters. For instance, in the oil and gas industry, fiber optic lines provide insights into well conditions, including pressure, temperature, flow rates, etc., enabling operators to enhance production efficiency. Nonetheless, the installation of communication lines, including fiber optics, poses challenges in wells with intricate geometries or restrictions.

One challenge in installing a communication line run down into a wellbore on a sub is to have the communication line connection positioned as radially outward on the sub as possible to increase the internal diameter of the sub for increased flowrate and an increased ability to pass tools through the sub. However, in doing so, the connection and thus the sub still have to be able to pass through internal restrictions in a pipe in the wellbore.

BRIEF DESCRIPTION OF THE DRAWINGS

Embodiments of the DOWNHOLE WET-MATE SYSTEMS WITH OFFSET STINGER AND METHODS FOR DEPLOYMENT AND WET-MATE CONNECTING BY ROTATION OF THE OFFSET STINGER are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
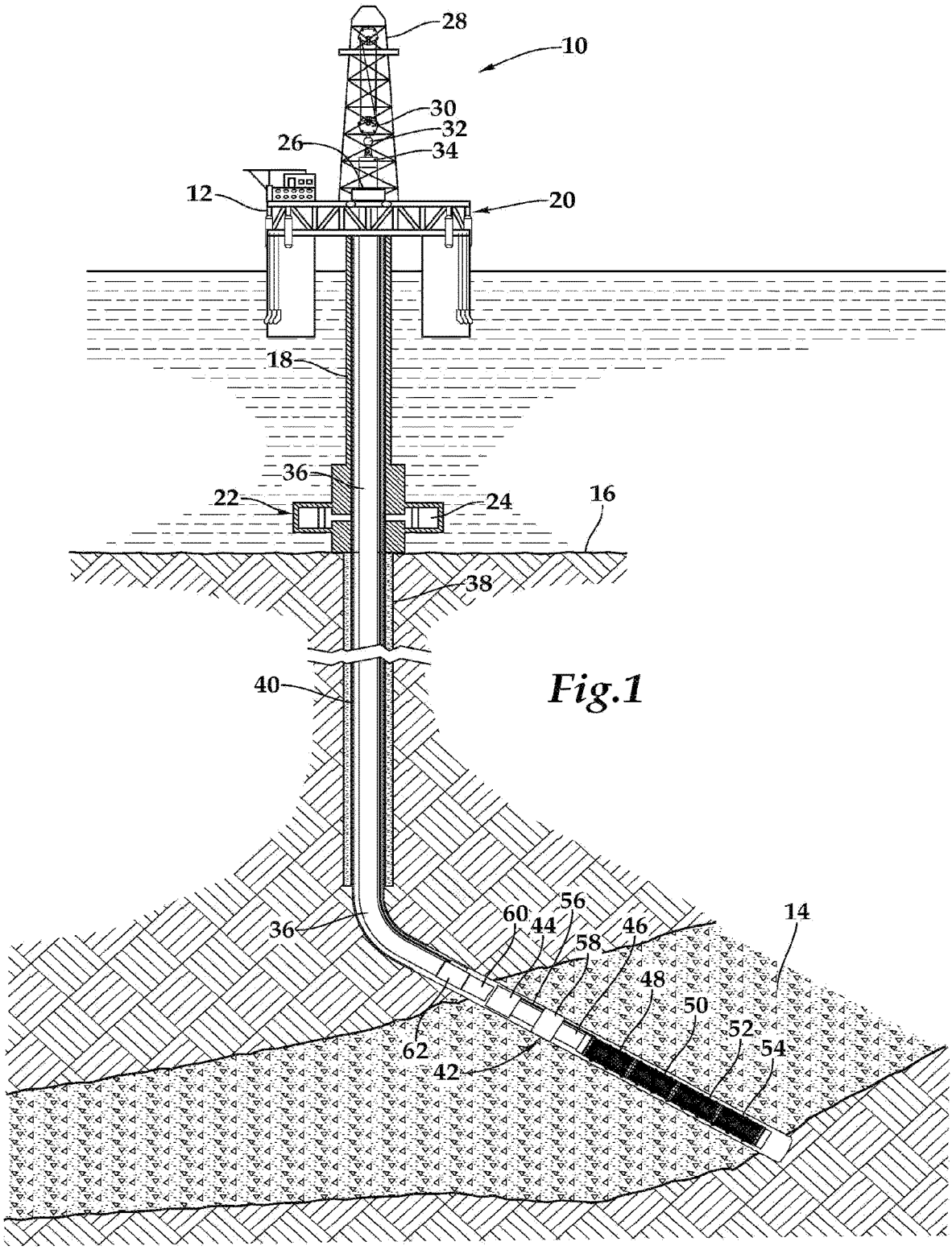
FIG. 1 is a schematic illustration of an offshore oil and gas platform operating an apparatus for installing a downhole completion system according to one or more embodiments.

The present disclosure helps address the issues discussed above. The present disclosure describes a wellbore completion system that uses a first portion wet-mate connector and a complementary second portion wet-mate connector. The first portion wet-mate connector is run into a wellbore on a conveyance such as a production string as part of an upper completion assembly. The upper completion assembly connects with a complimentary lower completion assembly that includes the complementary second portion wet-mate connector to establish the wet-mate connection.

The upper completion assembly includes an upper completion wet-mate sub that includes a stinger sub rotatably connected to a mandrel around an axis (stinger axis) that is offset from the axis of the conveyance (mandrel axis). The first portion wet-mate connector is mounted to the stinger sub at a radially outward portion relative to the central axis of the mandrel. Other than the azimuthal section where the first portion wet-mate connector is located, the stinger sub has a generally circular cross-section with a radius that is less than the radius of the position of the first portion wet-mate connector relative to the central axis of the mandrel.

When deployed, the stinger sub is at a first rotational position and the first portion wet-mate connector is at a radially outward position. With the connector in the radially outward position, the connector may encounter and engage with a restriction in the inside diameter of a pipe in the wellbore, preventing the upper completion assembly from continuing to move into the wellbore. When such an engagement occurs, continued movement of the conveyance causes the mandrel and the conveyance to move axially toward the stinger sub. Such relative axial movement rotates the stinger sub around the offset axis and to a second rotational position. Rotating the stinger sub also rotates the first portion wet-mate connector to a radially inward position relative to the mandrel compared to the radially outward position due to the rotation about the offset axis. Moving the first portion wet-mate connector radially inward disengages the first portion wet-mate connector from the restriction. The remaining circumference of the stinger sub is of a decreased radius and therefore the disengagement of the first portion wet-mate connector from the restriction disengages the rest of the stinger sub from the restriction. Disengaging the first portion wet-mate connector from the restriction thus allows the upper completion assembly to continue deployment into the wellbore.

Following disengagement with the restriction, the stinger sub returns to the first rotational position and the first portion wet-mate connector returns to the radially outward position for connection to the downhole fiber optic wet-mate connector further downhole. Having the first portion wet-mate connector positioned as radially outward as possible as described provides a larger internal diameter (ID) for production flow area and passing tools through wet-mate connector. Also, having the ability to move the first portion wet-mate connector from the radially outward position to the radially inward position achieves an effective smaller running outer diameter (OD) for passing restrictions inside pipe.

The lower completion assembly includes a lower completion wet-mate sub that includes a second portion wet-mate connector. The second portion wet-mate connector is located at a similar radially outward position as the first portion wet-mate connector. When the upper completion assembly engages the lower completion assembly, the first portion wet-mate connector is at the radially outward position and engages the second portion wet-mate connector to establish the wet-mate connection. The engagement of the upper completion assembly and the lower completion assembly also establishes a flowpath for production fluids to flow from the formation to the surface as part of completing the well.

In addition, gravel pack/frac pack equipment other items such as a packer, seal bore assembly, wet-mate orientation sub system, and screens may be deployed into the wellbore. Sand control systems, as used herein, may include: i) gravel packing, which involves the placement of small particles (usually sand or gravel) around the wellbore to create a permeable barrier that allows oil and gas to flow freely while filtering out sand and other solid particles; ii) standalone screens, which are screens that are placed in the wellbore to filter out sand and other solid particles while allowing oil and gas to flow through; iii) expandable screens, which are screens that can be expanded in the wellbore to create a barrier that filters out sand and other particles; iv) chemical treatments, which involve the injection of chemicals into the wellbore to help prevent sand from accumulating and clogging the production equipment; and v) openhole completions, which allow the reservoir to maintain its natural structure while filtering out sand and other particles.

The first portion wet-mate connector can also be moved radially inward while tripping out of the wellbore. As the upper completion assembly is removed from the wellbore, the stinger sub is in the first rotational position and the first portion wet-mate connector is in the radially outward position. When the upper completion wet-mate sub engages a restriction inside the pipe, the upper completion assembly may be prevented from continuing to trip out of the wellbore. When such engagement occurs, continued movement of the conveyance uphole causes the mandrel and the conveyance to move axially away from the stinger sub. Such relative axial movement rotates the stinger sub around the offset axis and to a second rotational position. Rotating the stinger sub also rotates the first portion wet-mate connector to a radially inward position relative to the mandrel compared to the radially outward position due to the rotation about the offset axis. Moving the first portion wet-mate connector radially inward disengages the upper completion wet-mate sub from the restriction and allows the upper completion assembly to continue to trip out of the wellbore.

Turning now to the figures, FIG. 1 is a schematic illustration of an offshore oil and gas drilling and completion system 10 for drilling an offshore wellbore 38. Although an offshore wellbore 38 is illustrated, it should be appreciated that the present disclosure is also applicable to a land based wellbore. A semi-submersible platform 12 is located over a submerged subterranean oil and gas formation 14 located below a sea floor 16. A subsea conduit 18 extends from a deck 20 of the platform 12 to a wellhead installation 22, which includes at least one blowout preventer 24. The platform 12 has a hoisting apparatus 26, a derrick 28, a travel block 30, a hook 32, and a swivel 34 for raising and lowering pipe strings, such as a substantially tubular, axially extending production tubing 36. The production tubing 36 is part of an upper completion assembly shown in FIG. 1 as not yet being connected with a lower completion assembly. Disposed in the wellbore 38 at the lower end of the production tubing string 36 are a variety of tools included as part of the upper completion assembly such as a mandrel 62 and a stinger sub 60 that includes a first portion wet-mate connector.

The wellbore 38 extends through the various earth strata including the formation 14. An upper portion of the wellbore 38 includes a casing 40 that is cemented within the wellbore 38. Disposed in an open hole portion of the wellbore 38 is a lower completion assembly 42. The lower completion assembly 42 can also include various tools such as a packer 44, a seal bore assembly 46, and sand control screen assemblies 48, 50, 52, 54. The sand control screen assemblies 48, 50, 52 and 54 can be considered examples of a sand control system. The lower completion assembly 42 also includes an orientation and alignment subassembly and lower completion wet-mate sub 56 that houses a downhole wet-mate connector (discussed further below). Extending downhole from the lower completion wet-mate sub 56 is a conduit 58 that passes through the lower completion assembly and is operably associated with the sand control screen assemblies 48, 50, 52, 54.

FIGS. 2-6 illustrate of a completion system 100 in accordance with one or more embodiments. As shown, the completion system 100 includes an upper completion assembly 102 and a lower completion assembly 104 (shown connected in FIGS. 2 and 3). The upper completion assembly 102 is connected to a production tubing string as shown in FIG. 1 and includes an upper completion wet-mate sub 106. The upper completion wet-mate sub 106 includes a mandrel 108 and a stinger sub 110 rotatably connected to the mandrel 108 to be rotatable around an axis (stinger axis 112) that is offset from the axis of the mandrel (mandrel axis 114). The upper completion assembly 102 may also include various types of valves, chokes, packers, and other devices used to control the flow of fluids and gas from the wellbore.

The upper completion assembly 102 also includes a first portion energy transfer line or fiber optic cable 116 that terminates in a first portion wet-mate connector 118. As shown more clearly in FIG. 4, the first portion wet-mate connector 118 is mounted to the stinger sub 110 such that the first portion wet-mate connector 118 is in a radially outward position relative to the central axis 114 of the mandrel 108 in a first rotational position. Other than the azimuthal section where the first portion wet-mate connector 118 is located, the stinger sub has a generally circular cross-section with a radius that is less than the radially outward position of the first portion wet-mate connector relative to the central axis 114 of the mandrel 108. Having the first portion wet-mate connector positioned as radially outward as possible as described provides a larger internal diameter (ID) for production flow area and passing tools through wet-mate connector.

The lower completion assembly 104 includes a lower completion wet-mate sub 120 that includes a housing 122 connected to a bottom sub 124. The bottom sub 124 includes an axially oriented receptacle 126 and a second portion wet-mate connector 128, connected to which is a second portion energy transfer line or fiber optic cable 130. The lower completion assembly 104 may also include components such as sand control screens, fluid flow control devices, wellbore isolation devices, and the like. The second portion fiber optic cable 130 may be used to convey energy or communication signals and may also be used as a sensor to detect one or more conditions relating to the production of formation fluids.

Figure 2:
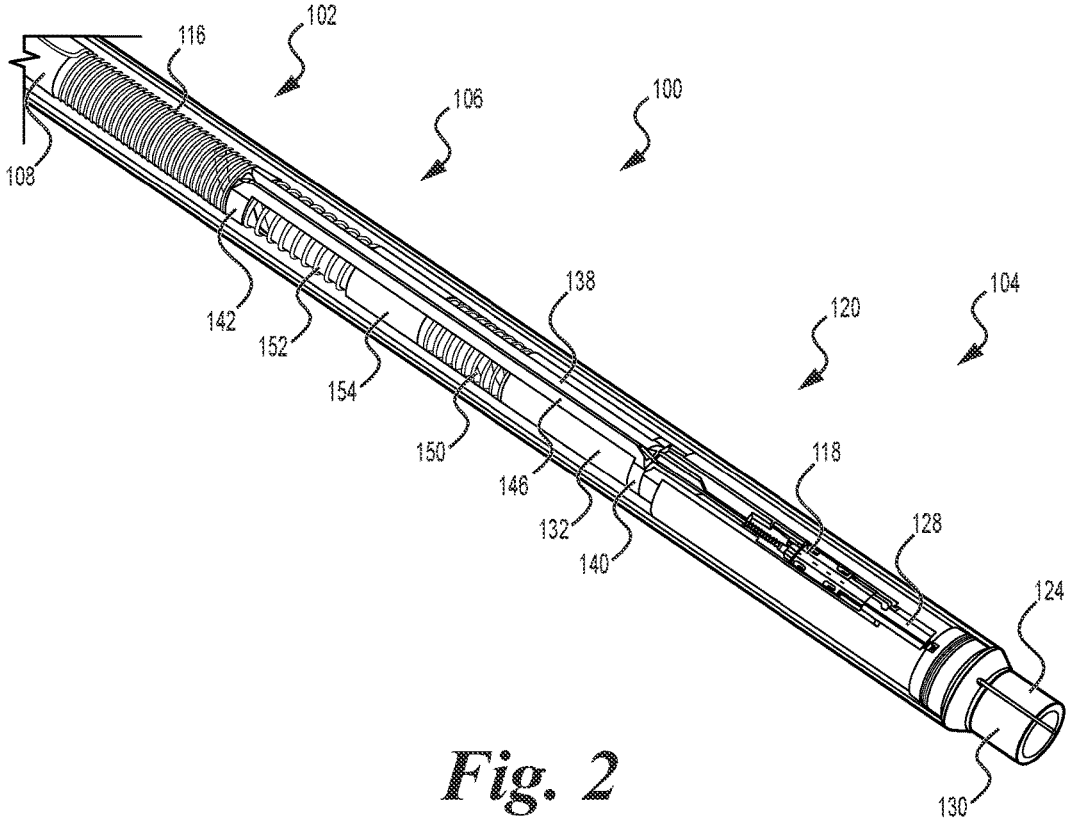
FIG. 2 is an isometric illustration of a completion system in accordance with one or more embodiments.
Figure 3:
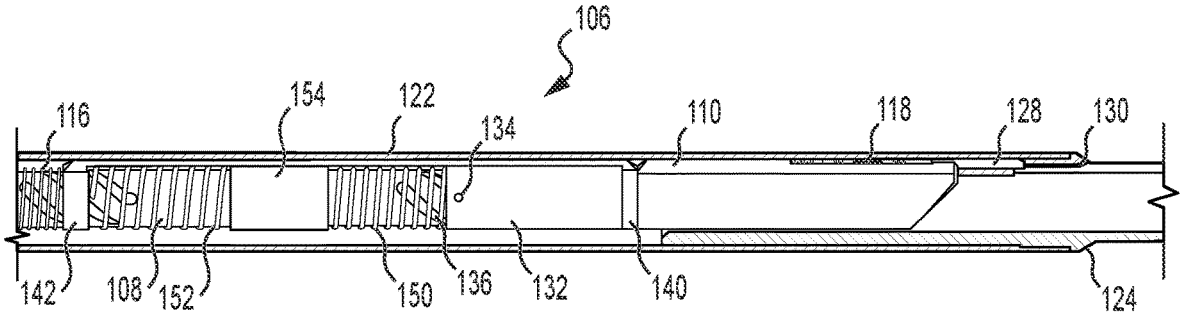
FIG. 3 is a side view illustration of the completion system of FIG. 2 showing the wet-mate connection.
Figure 4:
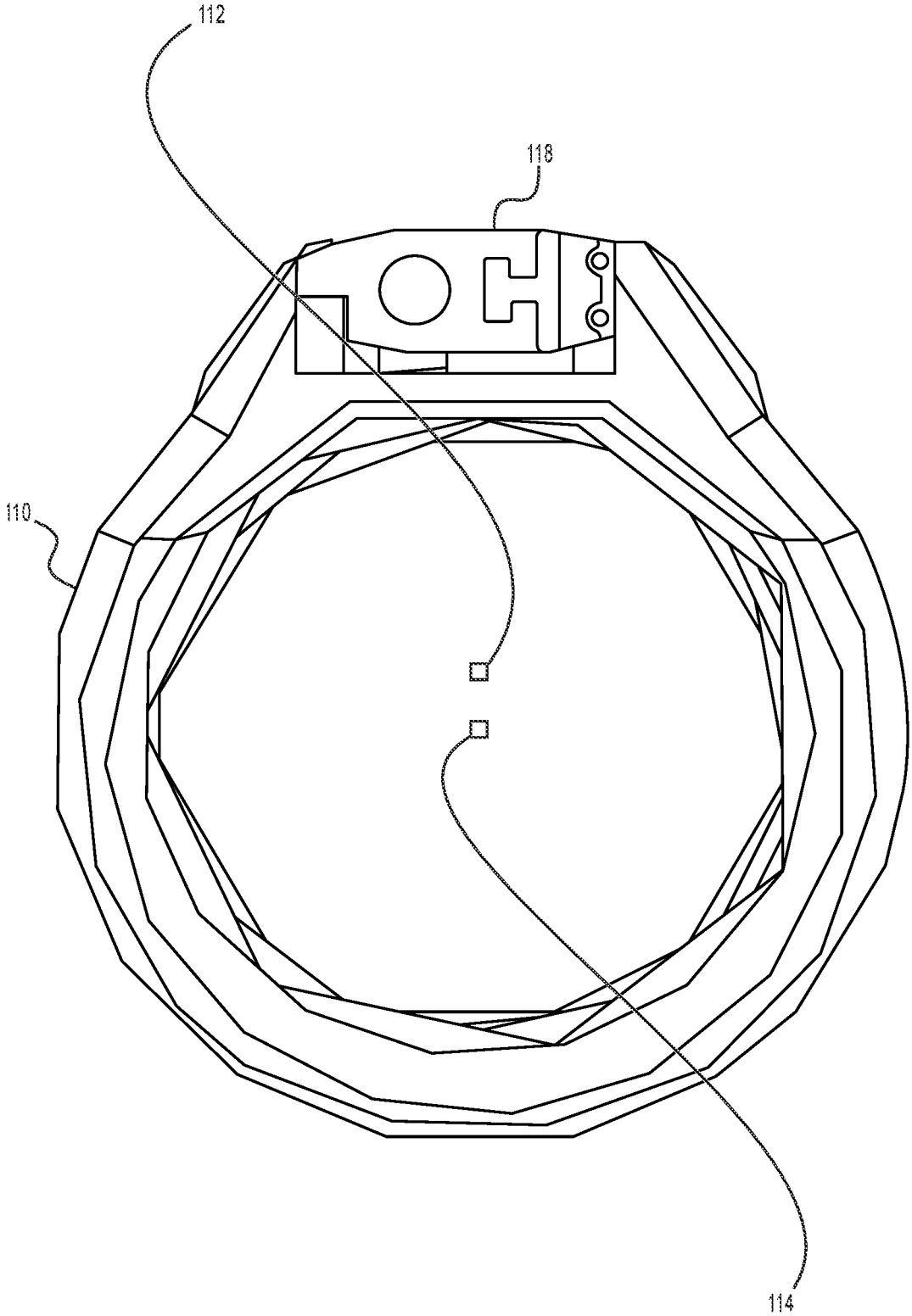
FIG. 4 is an end view illustration of the upper completion of FIG. 2.
Figure 5:
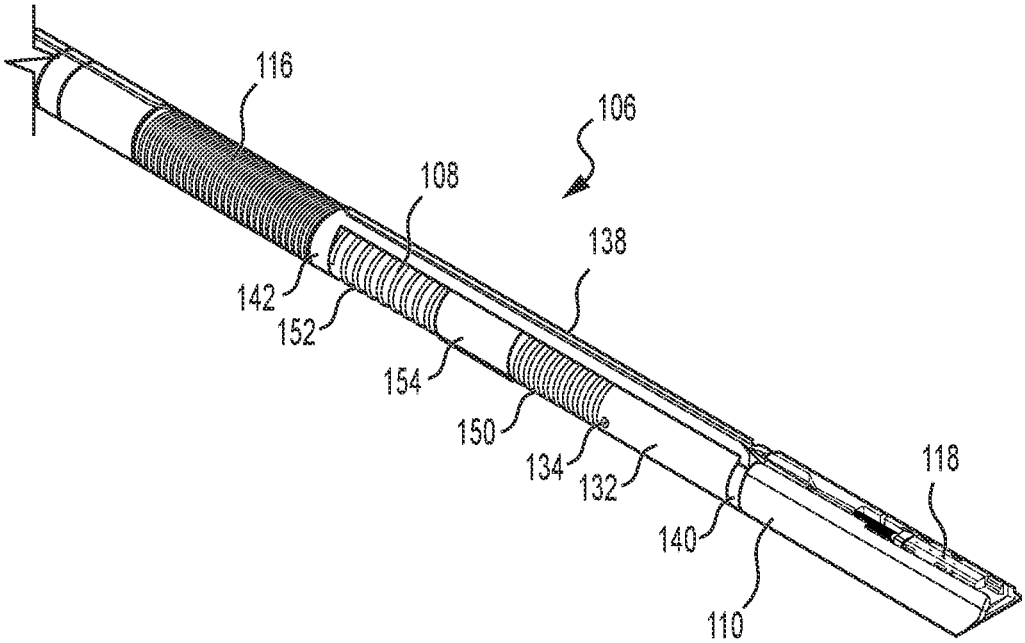
FIG. 5 is an isometric illustration of a upper completion wet-mate sub of the completion system of FIG. 2.
Figure 6:
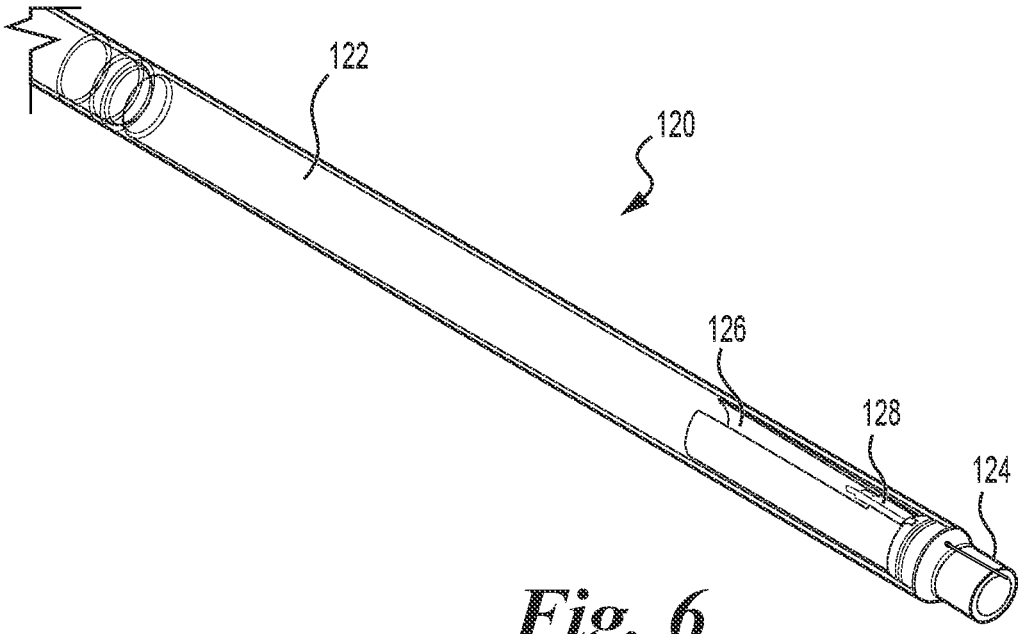
FIG. 6 is an isometric illustration of a lower completion wet-mate sub of the completion system of FIG. 2.

As shown in FIGS. 2 and 3, the upper completion assembly 102 and the lower completion assembly 104 engage each other to engage the first portion wet-mate connector 118 with the second portion wet-mate connector 128 to establish a wet-mate connection. As described herein, the terms "first portion" and "second portion" may be used to differentiate between the two components of the wet-mate connection. Also described herein, the terms "first wet-mate" and "second wet-mate" may be used to differentiate between the terms the "plug" and the "socket" or the "male" and the "female" for the two components. In addition, the general term "wet-mate connector" or "connector" may be used. In some embodiments, a system can use a socket wet-mate connector, for example positioned on an upper completion assembly, and a mating plug wet-mate connector, for example positioned on a lower completion assembly.

Although the completion system 100 is described as including fiber optic wet-mate connectors and fiber optic lines, the completion system 100 may also or in the alternative include electric, hydraulic, electro-hydraulic, or electro-fiber wet-mate connectors, any other suitable wet-mate connectors, or any combination thereof and corresponding similar lines. There may also be more than one wet-mate connector such as two or more on parallel lines. There may be wet-mate connectors with one or more types of energy used. For example, there may be two fiber optic wet-mate connectors in parallel, there may be three fiber optic lines and one electrical wet-mate connector. There may be one or combinations of all the above in various arrangements and combinations. In addition to fiber optic lines, energy transfer lines may be used. As described herein, an "energy transfer line" can be used to transfer one or more energy signals. The energy transfer line can be used to convey energy from or to another locale, or device, which may be located at the surface of the well or somewhere else. The energy transfer line may transfer one or more forms of energy. For example the following forms (or types) of energy or energy transfer may be used: light, electric, fluid (hydraulic, water, fuel, etc.), magnetic, electromagnetic (all forms), thermal (heat), acoustic (sound), motion (mechanical), inductive, etc. The energy transfer line may be used to transfer power, signals, data, information, conditional information, sensed information or data, computed information or data, logical information, filtered or conditioned information, data, or power, unfiltered information, data, or power, etc. The transfer of energy may be continuous (i.e., DC current), alternating (i.e., AC current), pulsed (i.e., digital 1s and 0s, pressure pulses, flow pulses, current or voltage changes, etc.). The transfer of energy may be unidirectional (i.e., from surface down) or bidirectional (i.e., from surface down and from subterranean to surface, etc.). Furthermore, there may be more than one energy transfer line such as two or more approximately parallel lines. There may be an energy transfer line with one or more types of energy used. For example, there may be two fiber optic fibers run in parallel, there may be three fiber optic lines and one electrical line, there may be two twisted electrical lines, there may be two electromagnetic field shielded electric lines, etc. There may be one or combinations of all the above in various arrangements and combinations.

Turning again to the upper completion wet-mate sub 106, the stinger sub 110 is a component of the upper completion assembly 102 that is used to direct the flow of hydrocarbons from the wellbore into the production tubing. The stinger sub 110 is attached through the mandrel 108 to the bottom of the production tubing that extends down into the wellbore to establish a fluid connection between the lower completion assembly 104 and the production tubing of the upper completion assembly 102. The stinger sub 110 may be perforated along its length to allow fluid to flow into the stinger sub 110 and then to the production tubing. The stinger sub 110 may be helpful in wells that produce from multiple zones or in situations where it is desirable to isolate certain sections of the wellbore to optimize production.

As previously discussed, the stinger sub 110 is rotatably connected with the mandrel 108. In addition to being rotatably connected, the stinger sub 110 is also movable axially with respect to the mandrel 108 by being connected to a rotation sleeve 132. The rotation sleeve 132 slides over the mandrel 108 and includes internal extensions or pins 134 that travel within lower helical grooves 136 on the outside of the mandrel 108. Thus, as the stinger sub 110 and the rotation sleeve 132 move axially toward the mandrel 108, the pins 134 travel within the lower helical grooves 136, causing the stinger sub 110 to rotate around the stinger axis 112.

To help protect the first portion cable 116 during repeated relative movement between the stinger sub 110 and the mandrel 108, the upper completion wet-mate sub 106 further includes a cable channel 138 that includes a lower channel collar 140 that extends around the mandrel 108 and is located between the stinger sub 110 and the rotation sleeve 132. The cable channel 138 also includes an upper channel collar 142 that likewise extends around the mandrel 108 and is slidable over the mandrel 108. Although not shown, the upper channel collar 142 also includes internal extensions or pins that travel within upper helical grooves 144. Connecting the lower channel collar 140 and the upper channel collar 142 is a channel connector 146 extending between the collars 140, 142. The channel connector 146 includes an outer channel 148 sized to house and protect the first portion cable 116 as the first portion cable 116 extends from the stinger sub 110 and over the helical grooves 136, 144. The lower channel collar 140 includes an entrance to the outer channel 148 and the upper channel collar 142 includes an exit from the outer channel 148 to help position the first portion cable 116 into the outer channel 148. To allow for relative rotational movement of the cable channel 138, the first portion cable 116 as illustrated may be coiled around the mandrel 108 to help secure the first portion cable 116 in place. The pitch of the upper helical grooves 144 matches the pitch of the lower helical grooves 136 such that the rotation of the lower channel collar 140 in the lower helical grooves 136 is the same as the rotation of the upper channel collar 142 in the upper helical grooves 144.

Located between the lower channel collar 140 and the upper channel collar 142, and more specifically between the rotation sleeve 132 and the upper channel collar 142 are a lower spring 150 and an upper spring 152. The lower spring 150 and the upper spring 152 are separated by a collar 154 in between the springs 150, 152. While the springs 150, 152 are slidable over the mandrel 108, the collar 154 has a larger diameter such that the springs 150, 152 cannot travel over the collar 154. The rotation sleeve 132 likewise blocks the lower spring 150 from moving past the rotation sleeve 132 and the upper channel collar 142 blocks the upper spring 152 from moving past the upper channel collar 142. The springs 150, 152 may be balanced such that they position the stinger sub 110, the rotation sleeve 132, and the cable channel 138 in the first rotational position shown in FIGS. 2, 3, and 5 unless an outside force acts to move the stinger sub 110 axially relative to the mandrel 108 and thus rotate the stinger sub 110 away from the first rotational position. However, after the external force is removed, the springs 150, 152 act to move the stinger sub 110 back to the first rotational position.

FIGS. 7-11 illustrate an example of the upper completion assembly 102 being deployed into the wellbore and navigating past an internal restriction 162 inside of a pipe 160 located in the wellbore. As previously described, the upper completion assembly 102 includes the upper completion wet-mate sub 106 that includes the stinger sub 110 rotatably connected to the mandrel around a stinger axis 112 that is offset from the mandrel axis 114. The first portion wet-mate connector 118 is mounted to the stinger sub 110 at a radially outward position relative to the mandrel axis 114.

Figure 7:
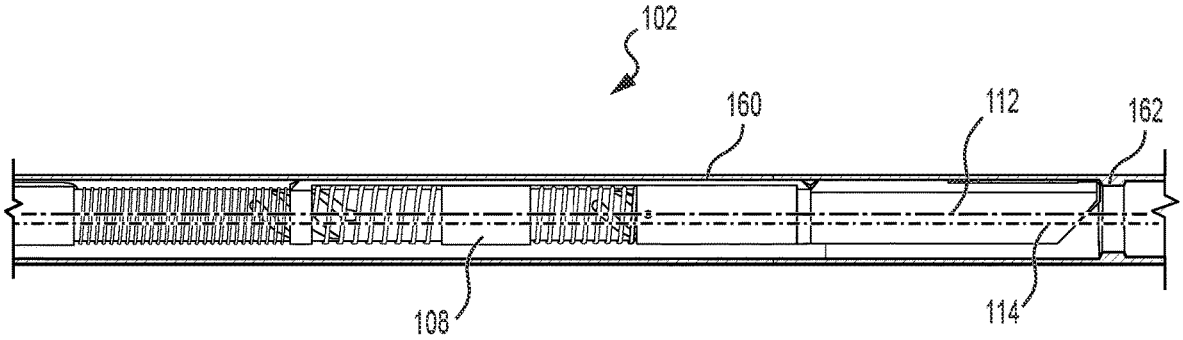
FIG. 7 is a side illustration of the upper completion system being deployed in a wellbore in a first rotational position and engaged with a restriction in a pipe.
Figure 8:
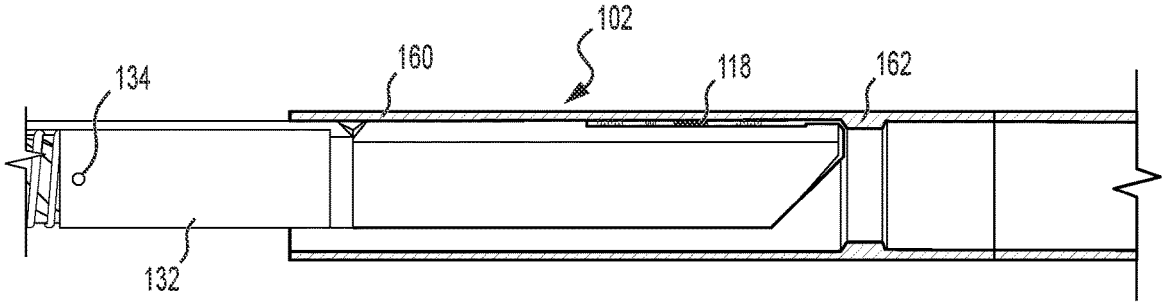
FIG. 8 is a side view illustration of a stinger sub of the upper completion assembly of FIG. 7 engaged with the restriction.
Figure 9:
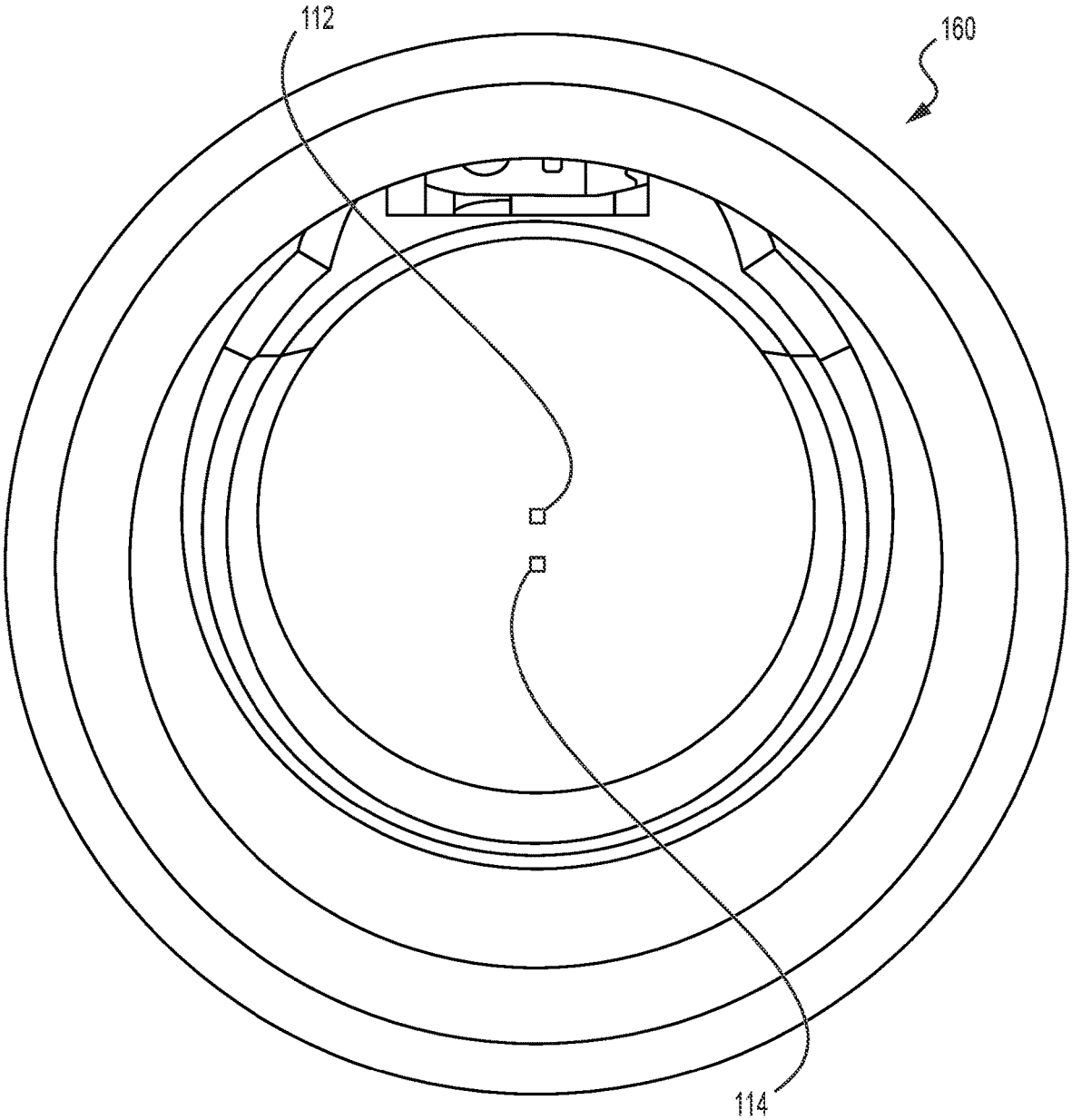
FIG. 9 is an end view illustration of the stinger sub of the upper completion assembly of FIG. 7 engaged with the restriction.

When deployed, the springs 150, 152 maintain the stinger sub 110 at the first rotational position and the first portion wet-mate connector 118 is at the radially outward position. With the first portion wet-mate connector 118 in the radially outward position, the connector may encounter and engage with the restriction 162 in the inside diameter of the pipe 160 in the wellbore, preventing the upper completion assembly 102 from continuing to move into the wellbore as shown in FIGS. 7-9.

Figure 10:
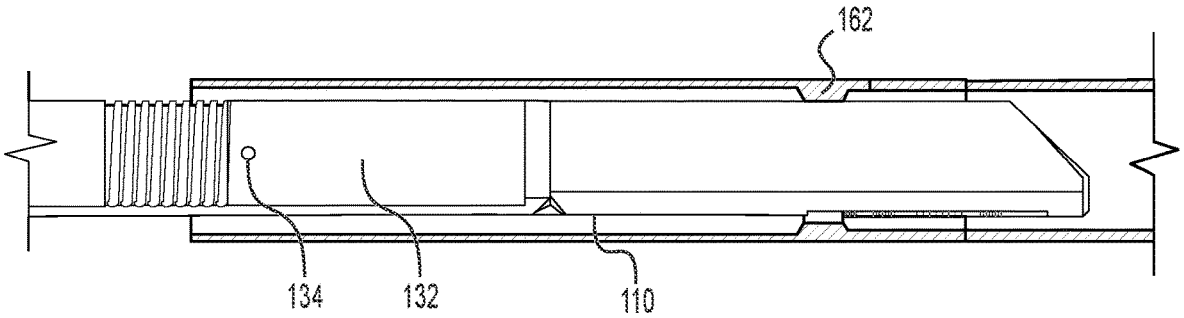
FIG. 10 is a side view illustration of the upper completion assembly in a second rotational position and disengaged with the restriction in the pipe.
Figure 11:
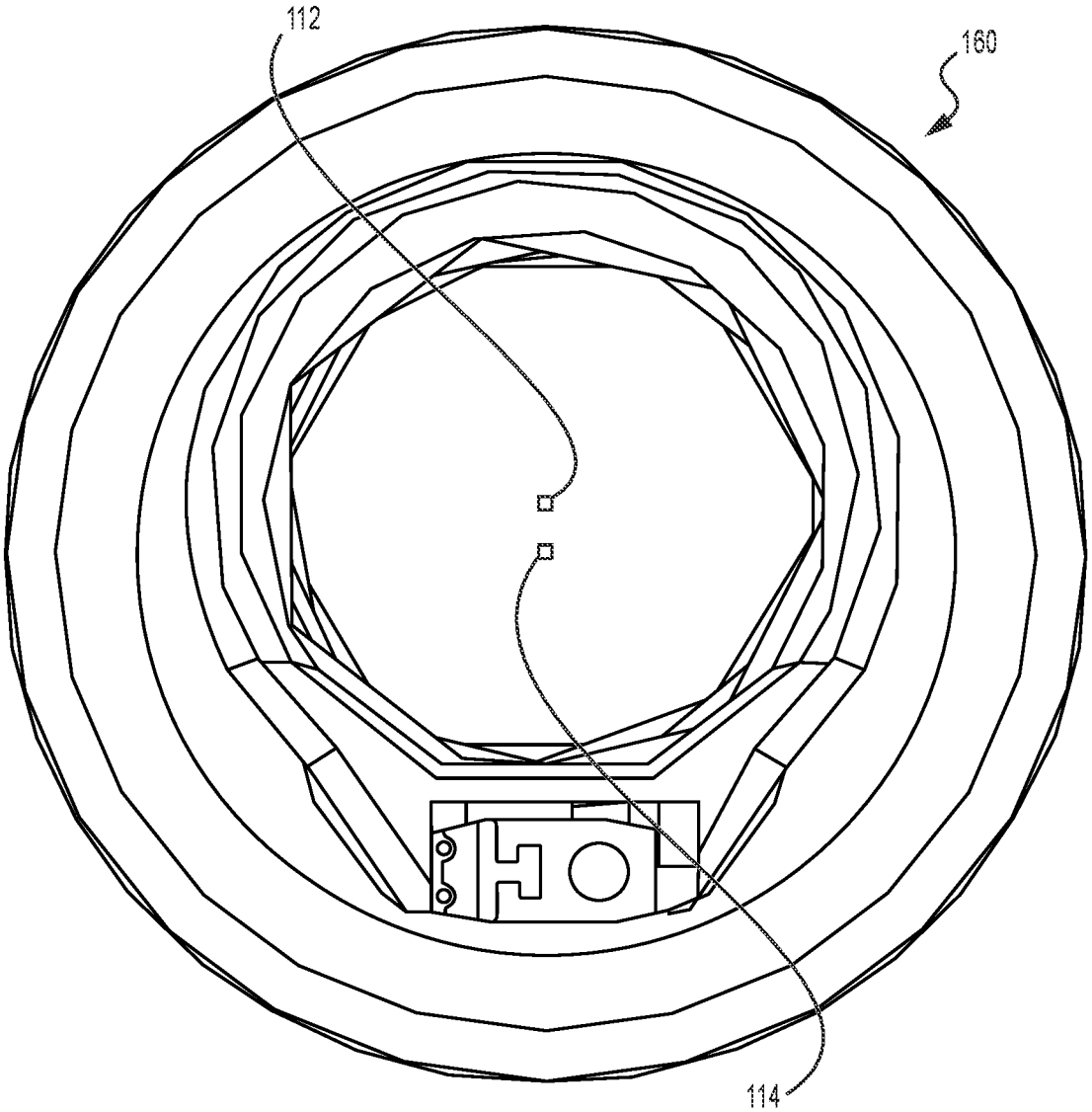
FIG. 11 is an end view illustration of the stinger sub of the upper completion assembly of FIG. 10 disengaged with the restriction.

When such an engagement occurs, continued movement of the conveyance and the mandrel 108 in the downhole direction causes the mandrel 108 and the conveyance to move axially toward the stinger sub 110. Such relative axial movement is due to the collapsing of the lower spring 150 and the travel of the rotation sleeve 132 over the mandrel 108. Such relative axial movement rotates the stinger sub 110 around the offset stinger axis 112 and to a second rotational position due to the travel of the pins 134 within the lower helical grooves 136. Rotating the stinger sub 110 also rotates the first portion wet-mate connector 118 to a radially inward position relative to the mandrel compared to the radially outward position due to the rotation of the stinger sub 110 about the offset stinger axis 112. Moving the first portion wet-mate connector 118 radially inward disengages the first portion wet-mate connector 118 from the restriction 162 and allows the upper completion assembly 102 to continue deployment into the wellbore as shown in FIGS. 10 and 11.

Following disengagement with the restriction 162, the collapsing force against the lower spring 150 is removed and the lower spring 150 extends to axially and rotationally move the stinger sub 110 to the first rotational position. Doing so also returns the first portion wet-mate connector 118 to the radially outward position. Having the ability to move the first portion wet-mate connector from the radially outward position to the radially inward position achieves an effective smaller running outer diameter (OD) for passing restrictions inside the pipe 160 because the radius of the outer surface of the rest of the stinger sub 110 is not as great as the radius to the first portion wet-mate connector 118.

The process of maneuvering past internal restrictions in the wellbore pipe as the upper completion assembly 102 is deployed into the wellbore until the upper completion assembly 102 reaches the lower completion assembly 104. Once the lower completion assembly 104 is reached, the upper completion assembly 102 engages the lower completion assembly to establish a fluid connection for flow of production fluids from the formation to the surface through the upper completion assembly 102. The upper completion assembly 102 also establishes the wet-mate connection between the first portion wet-mate connector 118 and the second portion wet-mate connector 128. For engagement, the stinger sub 110 aligns such that the first portion wet-mate connector 118 enters the receptacle 126 with the stinger sub 110 in the first rotational position. In this manner, not only is the first portion wet-mate connector azimuthally aligned with the second portion wet-mate connector 128, but the first portion wet-mate connector 118 is also at the radially outward position and thus aligned with the second portion wet-mate connector 128 in the radial direction as well. To align the first portion wet-mate connector 118 with the receptacle 126, the bottom sub 124 includes a reduced inner diameter compared with the housing 122, except for the receptacle 126. Thus, the bottom sub 124 is simply another internal restriction unless the first portion wet-mate connector 118 is aligned azimuthally with the receptacle 126. When the stinger sub 110 engages the bottom sub 124 unaligned, the continued movement of the mandrel 108 rotates the stinger sub 110 until the first portion wet-mate connector 118 fits into the receptacle 126. Once in the receptacle 126, the stinger sub 110 and the reduced inner diameter of the bottom sub 124 are sized so as to also move the first portion wet-mate connector 118 into radial alignment with the second portion wet-mate connector 128 as well. The upper completion assembly 102 then continues to move into the lower completion assembly 104 until the fluid connection and the wet-mate connection are made up as shown in FIG. 2.

Figure 12:
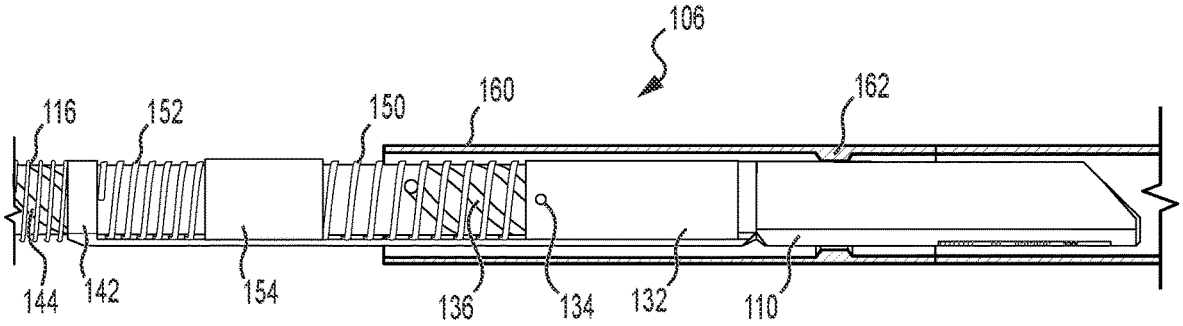
FIG. 12 is a side view of the upper completion assembly of FIG. 7 being retrieved from the wellbore.

FIG. 12 is a side view of the upper completion wet-mate sub 106 when moving uphole past an internal restriction 162 in a pipe 160 in the wellbore. Such a situation may arise during deployment of the upper completion wet-mate sub 106 if there is a reason to back up out of the wellbore before progressing further downhole. A situation may also arise where an operation is to be performed on the well that involves pulling or tripping out the entire upper completion assembly 102.

As the upper completion wet-mate sub 106 moves uphole through the wellbore, the springs 150, 152, bias the stinger sub 110 into the first rotational position with the first portion wet-mate connector 118 in the radially outward position. Should the stinger sub 110 engage the restriction 162, the upper completion wet-mate sub 106 operates to disengage from the restriction 162 is a similar manner as described above, except in reverse. Engagement with the restriction 162 may restrict the stinger sub 110 from moving further uphole. Further movement of the rest of the upper completion assembly 102 uphole then places a force on the stinger sub 110, causing the stinger sub 110 to move axially away from the mandrel 108, compressing the upper spring 152. Due to the helical grooves 136 and the rotation sleeve 132, the stinger sub 110 also rotates when moved axially away from the mandrel 108. As discussed above, when the stinger sub 110 rotates relative to the mandrel 108 the stinger sub 110 rotates around the stinger axis 112 that is offset from the mandrel axis 114. Thus, rotation of the stinger sub 110 moves the first portion wet-mate connector from the radially outward position to a more radially inward position and disengages the stinger sub 110 from the restriction 162 as shown in FIG. 12. After the load from the engagement with the restriction 162 is released, the compressed upper spring 152 extends, moving the stinger sub 110 back to the first rotational position. This process of engagement/disengagement with internal restrictions may be repeated throughout the movement of the upper completion wet-mate sub 106 in the uphole direction.

Further examples of the present disclosure are as follows:

Example 1. A completion system for use downhole in a wellbore, the wellbore including a pipe with a restriction inside the pipe. The system includes:

an upper completion assembly that includes:

a mandrel comprising a mandrel axis; and a stinger sub rotatably connected with the mandrel and rotatable around a stinger axis offset from the mandrel axis, the stinger sub further comprising a first portion wet-mate connector located in a radially outward portion of the stinger sub; and a lower completion assembly including a second portion wet-mate connector, wherein the first and second portion wet-mate connectors are connectable downhole when connecting the upper completion assembly and the lower completion assembly, and wherein rotation of the stinger sub around the stinger axis rotates and moves the radially outward portion radially inward with respect to the mandrel axis.

Example 2. The system of Example 1, wherein the stinger sub and thus the radially outward portion are rotatable around the stinger axis from a first rotational position to a second rotational position upon movement of the stinger sub toward the mandrel in the axial direction from a first axial position to a second axial position.

Example 3. The system of Example 2 and any combination of previous examples, wherein:

the stinger sub is moveable toward the mandrel in the axial direction upon the radially outward portion engaging the restriction while the mandrel continues to move downhole in the wellbore; and wherein moving the radially outward portion radially inward disengages the radially outward portion from the restriction and allows the upper completion assembly to continue moving into the wellbore past the restriction.

Example 4. The system of Example 3 and any combination of previous examples, wherein the upper completion assembly further includes a spring that is compressible upon movement of the stinger sub toward the mandrel in the axial direction, the spring actable to return the stinger sub to the first axial position and first rotational position upon the disengagement with the restriction.

Example 5. The system of Example 2 and any combination of previous examples, wherein the mandrel further includes helical grooves on an outer surface, the rotation of the stinger sub being caused by engagement with the helical grooves as the stinger sub moves axially relative to the mandrel.

Example 6. The system of Example 1 and any combination of previous examples, wherein the lower completion assembly further includes a sand control system comprising a gravel pack, a frack pack, a standalone screen, or any combination thereof.

Example 7. The system of Example 1 and any combination of previous examples, wherein the first and second portion wet-mate connectors include fiber optic, electric, hydraulic, electro-hydraulic, or electro-fiber wet-mate connectors, or any combination thereof.

Example 8. The system of Example 1 and any combination of previous examples, wherein the stinger sub includes a stinger sub inner diameter increased by the first portion wet-mate connector being located in the radially outward portion of the stinger sub compared to if the first portion wet-mate connector was not located as radially outward.

Example 9. The system of Example 1 and any combination of previous examples, wherein the upper completion assembly further includes:

an optical fiber extending from the first portion wet-mate connector and along an outside of the upper completion assembly; and a cable channel rotatable with the stinger sub, the optical fiber being located in the cable channel.

Example 10. A method of completing a well comprising a wellbore extending into a formation, including:

moving an upper completion assembly downhole into the wellbore, the upper completion assembly comprising a mandrel and a stinger sub;

moving the stinger sub axially toward the mandrel upon a radially outward portion of the stinger sub in a radially outward position engaging a restriction inside of a pipe in the wellbore that prevents further movement of the stinger sub while the mandrel continues to move into the wellbore;

rotating the stinger sub around a stinger axis that is offset from a mandrel axis upon moving the stinger sub axially toward the mandrel so as to rotate and move the radially outer portion radially inward with respect to the mandrel axis;

disengaging the radially outward portion from the restriction due to the radially outward portion being moved radially inward;

continuing to move the upper completion assembly past the restriction and further downhole into the wellbore; and connecting the upper completion assembly with a lower completion assembly in the wellbore, wherein the connecting comprises connecting a first portion wet-mate connection located in the radially outward portion with a second portion wet-mate connection located in the lower completion assembly.

Example 11. The method of Example 10 and any combination of previous examples, further including:

wherein moving the stinger sub axially toward the mandrel further includes moving the stinger sub from a first axial position and a first rotational position to a second axial position and a second rotation position and compressing a spring; and returning the stinger sub to the first axial position and the first rotational position upon the disengaging from the restriction.

Example 12. The method of Example 10 and any combination of previous examples, wherein rotating the stinger sub upon moving the stinger sub axially toward the mandrel comprises engaging helical grooves on an outer surface of the mandrel as the stinger sub moves axially.

Example 13. The method of Example 10 and any combination of previous examples, wherein the first and second portion wet-mate connectors include fiber optic, electric, hydraulic, electro-hydraulic, or electro-fiber wet-mate connectors, or any combination thereof.

Example 14. The method of Example 10 and any combination of previous examples, further including producing downhole fluids from the well through the upper completion assembly.

Example 15. The method of Example 14 and any combination of previous examples, further including restricting sand flow into the lower completion assembly from the formation using a sand control system comprising a gravel pack, a frack pack, a standalone screen, or any combination thereof.

Example 16. A downhole wet-mate connection system for establishing a wet-mate connection downhole in a wellbore, the wellbore including a pipe with a restriction inside the pipe, including:

a first body comprising a first axis;

a stinger sub rotatably connected with the first body and comprising a first portion wet-mate connector located in a radially outward portion of the stinger sub, the stinger sub also comprising a stinger axis parallel to and offset from the first axis; and a second body comprising a second portion wet-mate connector, wherein the first and second portion wet-mate connectors are connectable downhole when connecting the stinger sub and the second body, and wherein rotation of the stinger sub around the stinger axis rotates and moves the radially outward portion radially inward with respect to the first axis.

Example 17. The system of Example 16 and any combination of previous examples, wherein the stinger sub and thus the first portion wet-mate connector are rotatable around the stinger axis from a first rotational position to a second rotational position upon movement of the stinger sub toward the first body in the axial direction from a first axial position to a second axial position.

Example 18. The system of Example 17 and any combination of previous examples, wherein:

the stinger sub is moveable toward the first body in the axial direction upon the radially outward portion engaging the internal restriction while the first body continues to move downhole into the wellbore; and wherein moving the radially outward portion radially inward disengages the radially outward portion from the restriction and allows the first body and the stinger sub to continue moving downhole into the wellbore past the restriction.

Example 19. The system of Example 18 and any combination of previous examples further including a spring that is compressible upon movement of the stinger sub toward the first body in the axial direction, the spring actable to return the stinger sub to the first axial position and first rotational position upon the disengagement from the restriction.

Example 20. The system of Example 16 and any combination of previous examples, wherein the first body further comprises helical grooves on an outer surface, the rotation of the stinger sub caused by engagement with the helical grooves as the stinger sub moves axially relative to the first body.

Certain terms are used throughout the description and claims to refer to particular features or components. As one skilled in the art will appreciate, different persons may refer to the same feature or component by different names. This document does not intend to distinguish between components or features that differ in name but not function.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about," "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A completion system for use downhole in a wellbore, the wellbore including a pipe with a restriction inside the pipe, comprising:

an upper completion assembly comprising:

a mandrel comprising a mandrel axis; and a stinger sub rotatably connected with the mandrel and rotatable around a stinger axis offset from the mandrel axis, the stinger sub further comprising a first portion wet-mate connector located in a radially outward portion of the stinger sub; and a lower completion assembly comprising a second portion wet-mate connector, wherein the first and second portion wet-mate connectors are connectable downhole when connecting the upper completion assembly and the lower completion assembly, and wherein rotation of the stinger sub around the stinger axis rotates and moves the radially outward portion radially inward with respect to the mandrel axis.

2. The system of claim 1, wherein the stinger sub and thus the radially outward portion are rotatable around the stinger axis from a first rotational position to a second rotational position upon movement of the stinger sub toward the mandrel in the axial direction from a first axial position to a second axial position.

3. The system of claim 2, wherein:

the stinger sub is moveable toward the mandrel in the axial direction upon the radially outward portion engaging the restriction while the mandrel continues to move downhole in the wellbore; and wherein moving the radially outward portion radially inward disengages the radially outward portion from the restriction and allows the upper completion assembly to continue moving into the wellbore past the restriction.

4. The system of claim 3, wherein the upper completion assembly further comprises a spring that is compressible upon movement of the stinger sub toward the mandrel in the axial direction, the spring actable to return the stinger sub to the first axial position and first rotational position upon the disengagement with the restriction.

5. The system of claim 2, wherein the mandrel further comprises helical grooves on an outer surface, the rotation of the stinger sub being caused by engagement with the helical grooves as the stinger sub moves axially relative to the mandrel.

6. The system of claim 1, wherein the lower completion assembly further comprises a sand control system comprising a gravel pack, a frack pack, a standalone screen, or any combination thereof.

7. The system of claim 1, wherein the first and second portion wet-mate connectors comprise fiber optic, electric, hydraulic, electro-hydraulic, or electro-fiber wet-mate connectors, or any combination thereof.

8. The system of claim 1, wherein the stinger sub comprises a stinger sub inner diameter increased by the first portion wet-mate connector being located in the radially outward portion of the stinger sub compared to if the first portion wet-mate connector was not located as radially outward.

9. The system of claim 1, wherein the upper completion assembly further comprises:

an optical fiber extending from the first portion wet-mate connector and along an outside of the upper completion assembly; and a cable channel rotatable with the stinger sub, the optical fiber being located in the cable channel.

10. A method of completing a well comprising a wellbore extending into a formation, comprising:

moving an upper completion assembly downhole into the wellbore, the upper completion assembly comprising a mandrel and a stinger sub;

moving the stinger sub axially toward the mandrel upon a radially outward portion of the stinger sub in a radially outward position engaging a restriction inside of a pipe in the wellbore that prevents further movement of the stinger sub while the mandrel continues to move into the wellbore;

rotating the stinger sub around a stinger axis that is offset from a mandrel axis upon moving the stinger sub axially toward the mandrel so as to rotate and move the radially outer portion radially inward with respect to the mandrel axis;

disengaging the radially outward portion from the restriction due to the radially outward portion being moved radially inward;

continuing to move the upper completion assembly past the restriction and further downhole into the wellbore; and connecting the upper completion assembly with a lower completion assembly in the wellbore, wherein the connecting comprises connecting a first portion wet-mate connection located in the radially outward portion with a second portion wet-mate connection located in the lower completion assembly.

11. The method of claim 10, further comprising:

wherein moving the stinger sub axially toward the mandrel further comprises moving the stinger sub from a first axial position and a first rotational position to a second axial position and a second rotation position and compressing a spring; and returning the stinger sub to the first axial position and the first rotational position upon the disengaging from the restriction.

12. The method of claim 10, wherein rotating the stinger sub upon moving the stinger sub axially toward the mandrel comprises engaging helical grooves on an outer surface of the mandrel as the stinger sub moves axially.

13. The method of claim 10, wherein the first and second portion wet-mate connectors comprise fiber optic, electric, hydraulic, electro-hydraulic, or electro-fiber wet-mate connectors, or any combination thereof.

14. The method of claim 10, further comprising producing downhole fluids from the well through the upper completion assembly.

15. The method of claim 14, further comprising restricting sand flow into the lower completion assembly from the formation using a sand control system comprising a gravel pack, a frack pack, a standalone screen, or any combination thereof.

16. A downhole wet-mate connection system for establishing a wet-mate connection downhole in a wellbore, the wellbore including a pipe with a restriction inside the pipe, comprising:

a first body comprising a first axis;

a stinger sub rotatably connected with the first body and comprising a first portion wet-mate connector located in a radially outward portion of the stinger sub, the stinger sub also comprising a stinger axis parallel to and offset from the first axis; and a second body comprising a second portion wet-mate connector, wherein the first and second portion wet-mate connectors are connectable downhole when connecting the stinger sub and the second body, and wherein rotation of the stinger sub around the stinger axis rotates and moves the radially outward portion radially inward with respect to the first axis.

17. The system of claim 16, wherein the stinger sub and thus the first portion wet-mate connector are rotatable around the stinger axis from a first rotational position to a second rotational position upon movement of the stinger sub toward the first body in the axial direction from a first axial position to a second axial position.

18. The system of claim 17, wherein:

the stinger sub is moveable toward the first body in the axial direction upon the radially outward portion engaging the internal restriction while the first body continues to move downhole into the wellbore; and wherein moving the radially outward portion radially inward disengages the radially outward portion from the restriction and allows the first body and the stinger sub to continue moving downhole into the wellbore past the restriction.

19. The system of claim 18 further comprising a spring that is compressible upon movement of the stinger sub toward the first body in the axial direction, the spring actable to return the stinger sub to the first axial position and first rotational position upon the disengagement from the restriction.

20. The system of claim 16, wherein the first body further comprises helical grooves on an outer surface, the rotation of the stinger sub caused by engagement with the helical grooves as the stinger sub moves axially relative to the first body.

* * * * *